US006123650A

United States Patent [19]

Birrell

[11] Patent Number: 6,123,650

[45] Date of Patent: Sep. 26, 2000

[54] INDEPENDENT ELLIPTICAL MOTION EXERCISER

[75] Inventor: James S. Birrell, Seattle, Wash.

[73] Assignee: Precor Incorporated, Bothell, Wash.

[21] Appl. No.: 09/185,385

[22] Filed: Nov. 3, 1998

[51] Int. Cl.[7] ..... A63B 69/16; A63B 22/04

[52] U.S. Cl. ..... 482/70; 482/51; 482/52

[58] Field of Search ..... 482/51, 52, 53, 482/57, 70, 79, 80

[56] References Cited

U.S. PATENT DOCUMENTS

| | | |
|---|---|---|
| 219,439 | 9/1879 | Blend . |
| D. 299,369 | 1/1989 | Smith . |
| D. 330,236 | 10/1992 | Jarriel et al. . |
| D. 372,282 | 7/1996 | Pasero . |
| D. 409,477 | 4/1999 | Arnold . |
| D. 410,978 | 6/1999 | Littrell . |
| 518,757 | 5/1894 | Hoyt . |
| 1,273,906 | 7/1918 | Nickey . |
| 1,323,004 | 11/1919 | Boyd . |
| 2,603,486 | 7/1952 | Hughes . |
| 2,641,249 | 6/1953 | Brockman . |

(List continued on next page.)

FOREIGN PATENT DOCUMENTS

| | | |
|---|---|---|
| 2919494 | 11/1980 | Germany . |
| 0206208 | 7/1937 | Switzerland . |
| 1600816 | 10/1990 | U.S.S.R. . |

*Primary Examiner*—Stephen R. Crow

*Attorney, Agent, or Firm*—Christensen O'Connor Johnson & Kindness PLLC

[57] ABSTRACT

An exerciser (10) includes a floor engaging frame (14) and a forward upright post structure (18). Towards the rear of the frame (14) are attached left and right axle mount supports (22) and (24) which house a transverse axle (26). The axle (26) is bifurcated allowing the two halves to rotate independently of one another and connect to left and right drive wheels (30) and (32) respectively. Left and right foot link members (36) and (38) rollably engage the drive wheels at the link member's rear end portions (48) and (50). The forward end portions (42) and (44) of the foot link members rollably engage left and right inclinable guide ramps (60) and (62). The inclinable guide ramps (60) and (62) are biased rotationally upwardly, to resist downward forces, by biasing members, such as springs (74). Left and right foot support portions (54) and (56) are mounted on the foot link members. As the foot link members reciprocate forwardly and rearwardly along the inclinable guide ramps, the interaction of the oscillating weight of a running or walking user, together with the independently upwardly biased inclinable guide ramps (60) and (62), causes the foot support portions to travel along an elliptical path.

34 Claims, 9 Drawing Sheets

U.S. PATENT DOCUMENTS 2,826,192 3/1958 Mangas .
2,892,455 6/1959 Hutton .
3,316,898 5/1967 Brown .
3,432,164 3/1969 Deeks .
3,475,021 10/1969 Ruegsegger .
3,566,861 3/1971 Weiss .
3,713,438 1/1973 Knutsen .
3,759,511 9/1973 Zinkin et al. .
3,824,994 7/1974 Soderberg, Sr. .
4,023,795 5/1977 Pauls .
4,053,173 10/1977 Chase, Sr. .
4,185,622 1/1980 Swenson .
4,188,030 2/1980 Hooper .
4,379,566 4/1983 Titcomb .
4,456,276 6/1984 Bortolin .
4,505,473 3/1985 Pro .
4,509,742 4/1985 Cones .
4,555,109 11/1985 Hartmann .
4,561,318 12/1985 Schirrmacher .
4,645,200 2/1987 Hix .
4,679,786 7/1987 Rodgers .
4,700,946 10/1987 Breunig .
4,720,093 1/1988 Del Mar .
4,779,863 10/1988 Yang .
4,786,050 11/1988 Geschwender .
4,842,268 6/1989 Jenkins .
4,869,494 9/1989 Lambert, Sr. .
4,900,013 2/1990 Rodgers, Jr. .
4,949,954 8/1990 Hix .
4,949,993 8/1990 Stark et al. .
4,986,261 1/1991 Iams et al. .
4,989,857 2/1991 Kuo .
5,038,758 8/1991 Iams et al. .
5,039,087 8/1991 Kuo .
5,039,088 8/1991 Shifferaw .
5,131,895 7/1992 Rodgers, Jr. .
5,135,447 8/1992 Robards, Jr. et al. .
5,149,312 9/1992 Croft et al. .
5,169,363 12/1992 Campanaro et al. .
5,186,697 2/1993 Rennex .
5,242,343 9/1993 Miller .
5,269,736 12/1993 Roberts .
5,279,529 1/1994 Eschenbach .
5,279,530 1/1994 Hess .
5,290,211 3/1994 Stearns .
5,295,928 3/1994 Rennex .
5,299,993 4/1994 Habing .
5,352,169 10/1994 Eschenbach .
5,383,829 1/1995 Miller .
5,401,226 3/1995 Stearns .
5,403,255 4/1995 Johnston .
5,423,729 6/1995 Eschenbach .
5,499,956 3/1996 Habing et al. .
5,518,473 5/1996 Miller .
5,527,246 6/1996 Rodgers, Jr. .
5,529,554 6/1996 Eschenbach .
5,540,637 7/1996 Rodgers, Jr. .
5,549,526 8/1996 Rodgers, Jr. .
5,562,574 10/1996 Miller .
5,685,804 11/1997 Whan-Tong et al. ..... 482/51
5,848,954 12/1998 Stearns et al. ..... 482/70
5,857,941 1/1999 Maresh et al. ..... 482/70

INDEPENDENT ELLIPTICAL MOTION EXERCISER

FIELD OF THE INVENTION

The present invention relates to exercise equipment, and more specifically to a stationary device for simulating running and stepping type motions.

BACKGROUND OF THE INVENTION

The benefits of regular aerobic exercise have been well established and accepted. However, due to time constraints, inclement weather, and other reasons, many people are prevented from indulging in activities such as walking, jogging, running, and swimming. In response, a variety of exercise equipment have been developed for aerobic activity. It is generally desirable to exercise a large number of different muscles over a significantly large range of motion so as to provide for even physical development, to maximize muscle length and flexibility, and to achieve optimum levels of aerobic exercise. A further advantageous characteristic of exercise equipment, is the ability to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art, however this machine employs a sitting position which utilizes only a small number of muscles, throughout a fairly limited range of motion. Cross-country skiing devices are also utilized by many people to simulate the gliding motion of cross-country skiing. While this device exercises more muscles than a stationary bicycle, the substantially flat shuffling foot motion provided thereby, limits the range of motion of some of the muscles being exercised. Another type of exercise device simulates stair climbing. These devices also exercise more muscles than do stationary bicycles, however, the rather limited range of up-and-down motion utilized does not exercise the user's leg muscles through a large range of motion. Treadmills are still a further type of exercise device in the prior art, and allow natural walking or jogging motions in a relatively limited area. A drawback of the treadmill, however, is that significant jarring of the hip, knee, ankle and other joints of the body may occur through use of this device.

A further limitation of a majority of exercise systems in the prior art, is that the systems produce an equipment-induced, reciprocal coordinated motion between a user's legs. This motion can result in detrimental effects on a user's balance and muscle coordination due to the continued reliance on the forced coordinated motion produced by some prior art exercise equipment, as opposed to the natural independent motion that occurs in activities such as running, walking, etc. There is a continuing need for an exercise device that provides for smooth natural action, exercises a relatively large number of muscles through a large range of motion, and allows for independent bi-pedal motion instead of forced reciprocal coordinated motion.

SUMMARY OF THE INVENTION

The present invention discloses an exercise device that allows independent elliptical motion to be produced. The exercise device utilizes a frame that is configured to be supported on a floor. The frame defines a rearward transverse axle to which first and second foot links are rollably associated. The first and second foot links each have a forward end, a rearward end and a foot supporting portion. The rollable contact of the foot links with the transverse axle causes the forward ends of the foot links to travel along arcuate paths relative to the transverse axle. First and second guide ramps are supported by the frame and are operatively associated with the forward ends of the first and second foot links, so as to direct the foot links along mutually independent paths of travel, as the forward ends of the foot links travel along arcuate paths of motion.

In a preferred embodiment of the present invention, the transverse axle is located at the rearward end of the frame and operatively connects to a capstan drive, whereby the foot links each sweep out a uni-directional elliptical path along a closed pathway. The drive system is a bifurcated apparatus that allows the two foot links to move independently of one another. The transverse axle and capstan drive are further operationally associated with a one-way clutch system such that there is a greater resistance required to move the foot portions of the foot links from the forward to rearward positions, than there is to move the foot portions from the rearward to the forward positions. The device may also include a means for increasing the amount of resistance required to move the foot portions through the elliptical path, thereby increasing the level of energy output required from the user.

In another aspect of the present invention, the guide ramps of the exercise device are operationally induced incline-varying ramps. Specifically, the interaction of the foot links with the guide ramps acts to vary the angular orientation of the guide ramps, and thus the foot links relative to the frame. The biasing mechanism of the guide ramps is preferably either spring based, a teeter-totter type design, or a rope and pulley type design.

An exercise device constructed in accordance with the present invention implements independent elliptical motion to simulate natural walking and running motions and exercise a large number of muscles through a large range of motion. Increased balance and muscle coordination can also be derived through the natural independent bi-pedal motion of the present invention, as opposed to the continued reliance on the forced coordinated motion produced by some prior art exercise equipment. This device provides the above stated benefits without imparting the shock to the user's body joints in the manner of prior art exercise treadmills.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 2A illustrates a side view of an another embodiment of the present invention that incorporates resilience adjusting mechanisms, positionally adjustably mount supports, correspondingly shaped pinch/idler rollers and spool-shaped drive wheels, correspondingly shaped rollably engageable foot links and guide ramps, and a capstan drive that is dampened by biasing resilient members.

DETAILED DESCRIPTION OF THE PREFERRED EMBODIMENT

Figure 1:
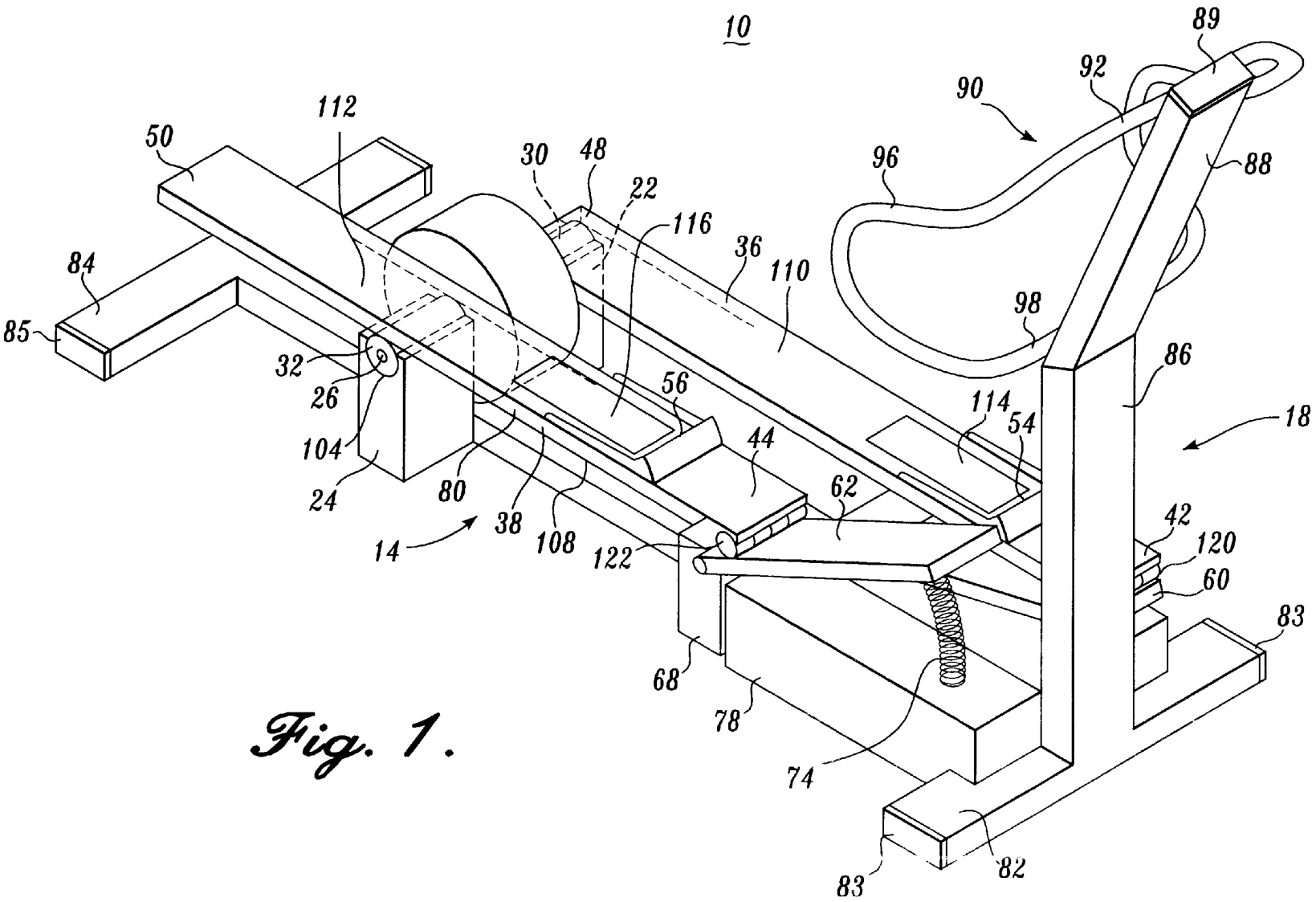
FIG. 1 illustrates an elevated perspective view of an independent elliptical motion exerciser of the present invention, utilizing spring biasing guide ramp returns.
Figure 2:
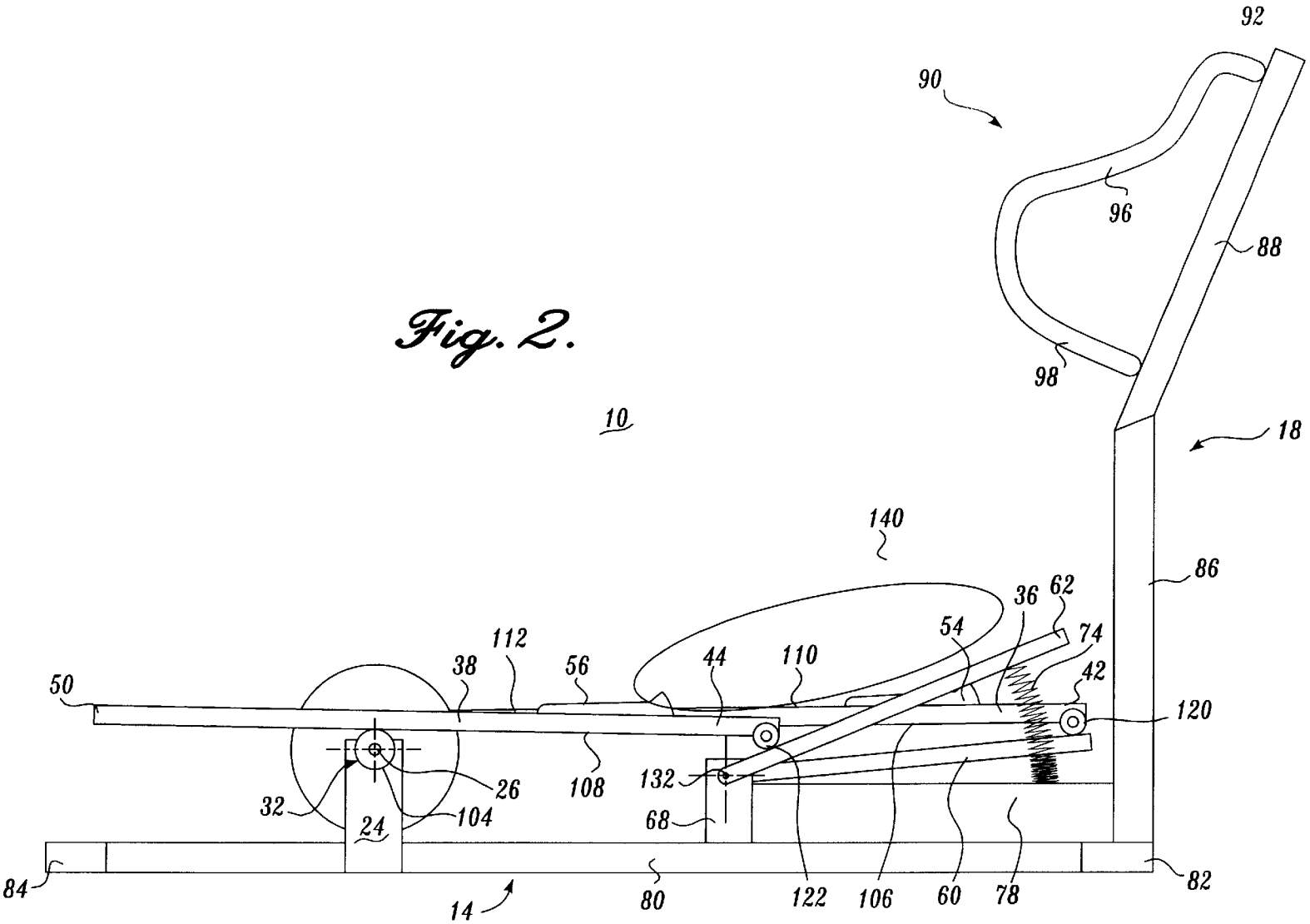
FIG. 2 illustrates a side view of the embodiment of the present invention shown in FIG. 1.
Figure 3:
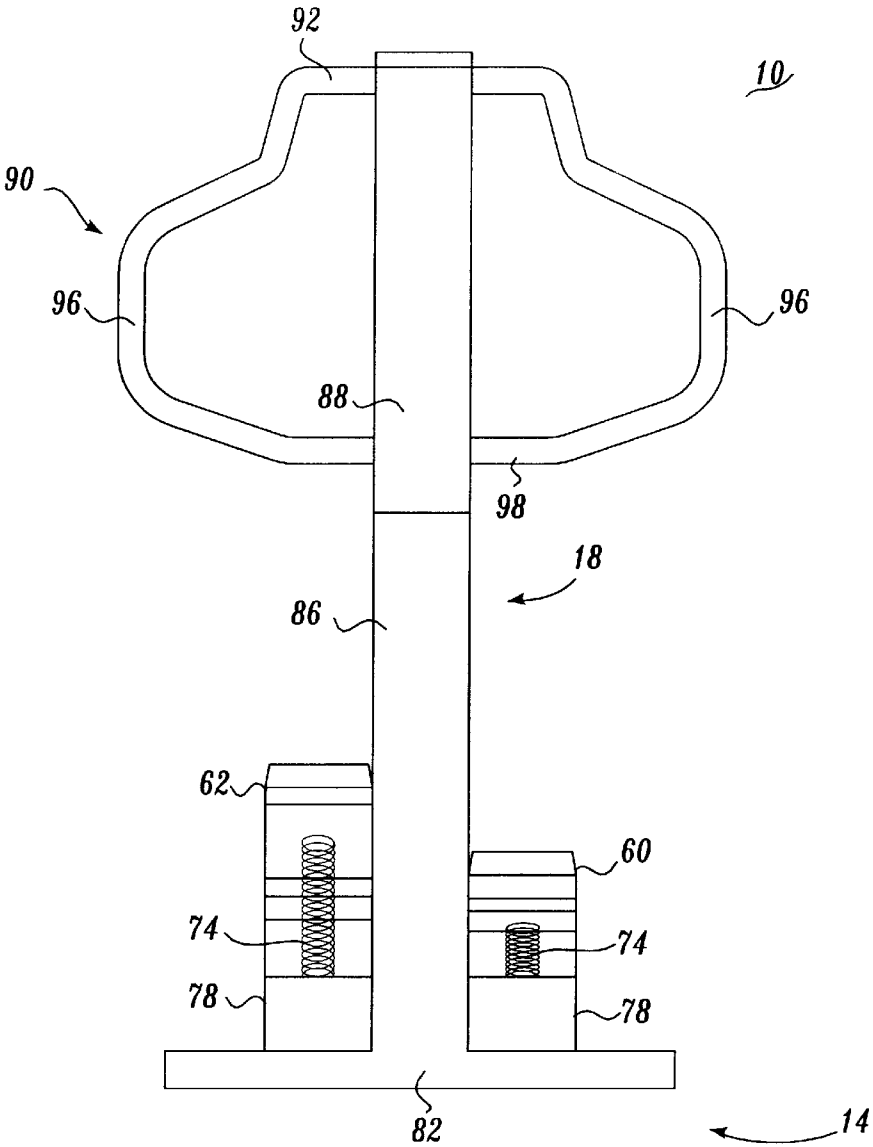
FIG. 3 illustrates a front view of the embodiment of the present invention shown in FIG. 1.
Figure 4:
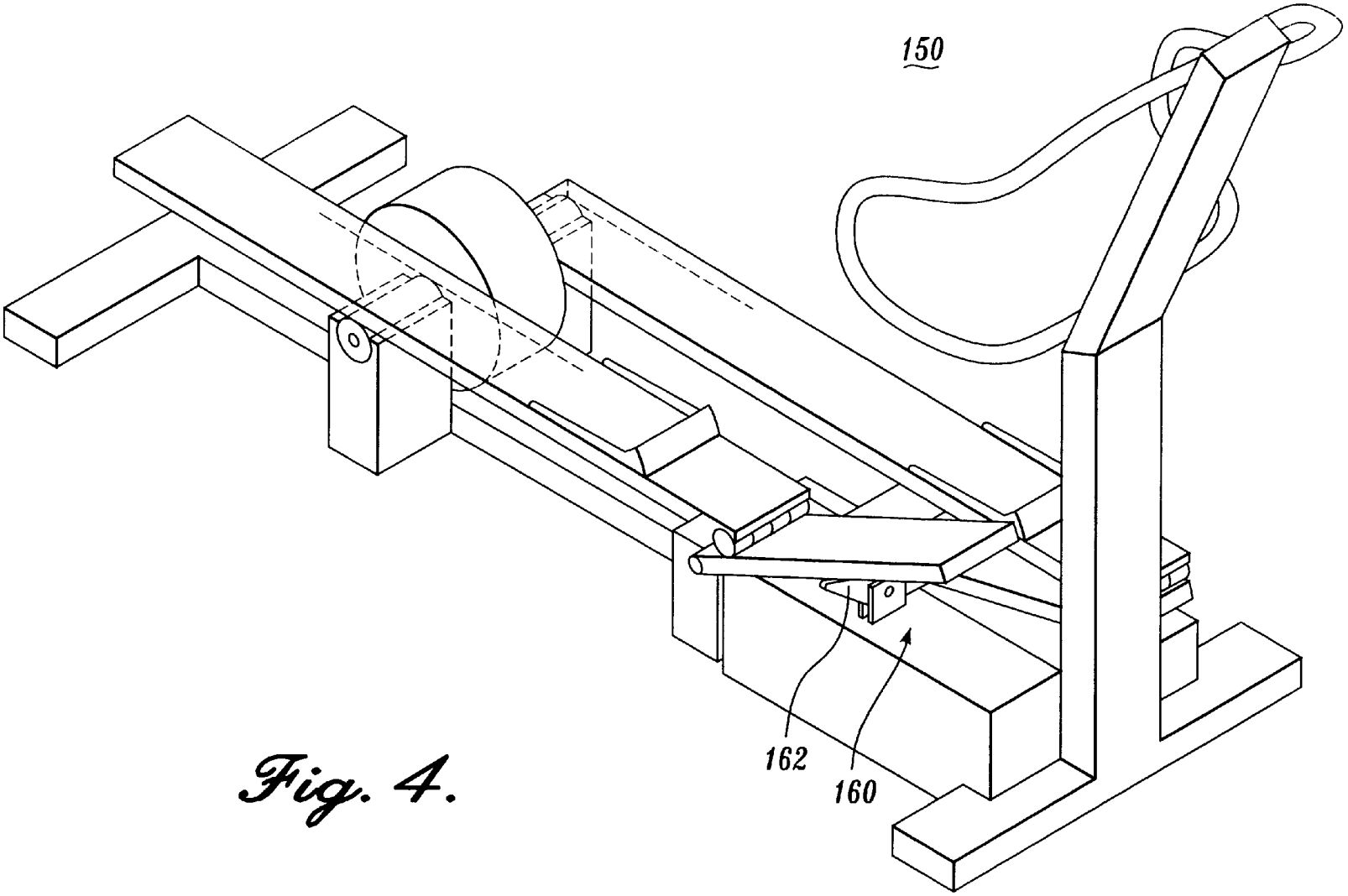
FIG. 4 illustrates an elevated perspective view of an independent elliptical motion exerciser of the present invention, utilizing a teeter-totter type guide ramp return.
Figure 5:
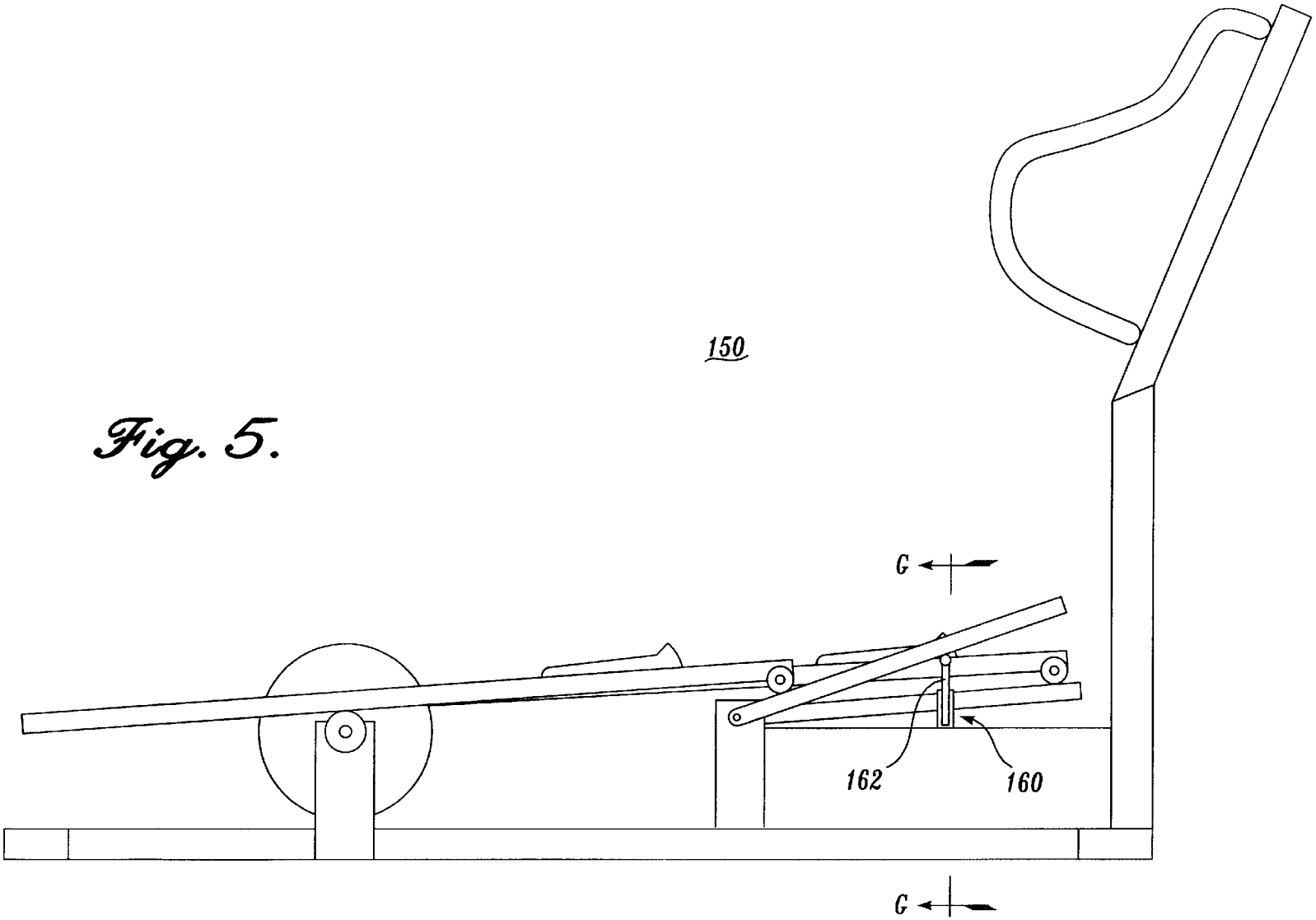
FIG. 5 illustrates a side view of the embodiment of the present invention shown in FIG. 4.
Figure 6:
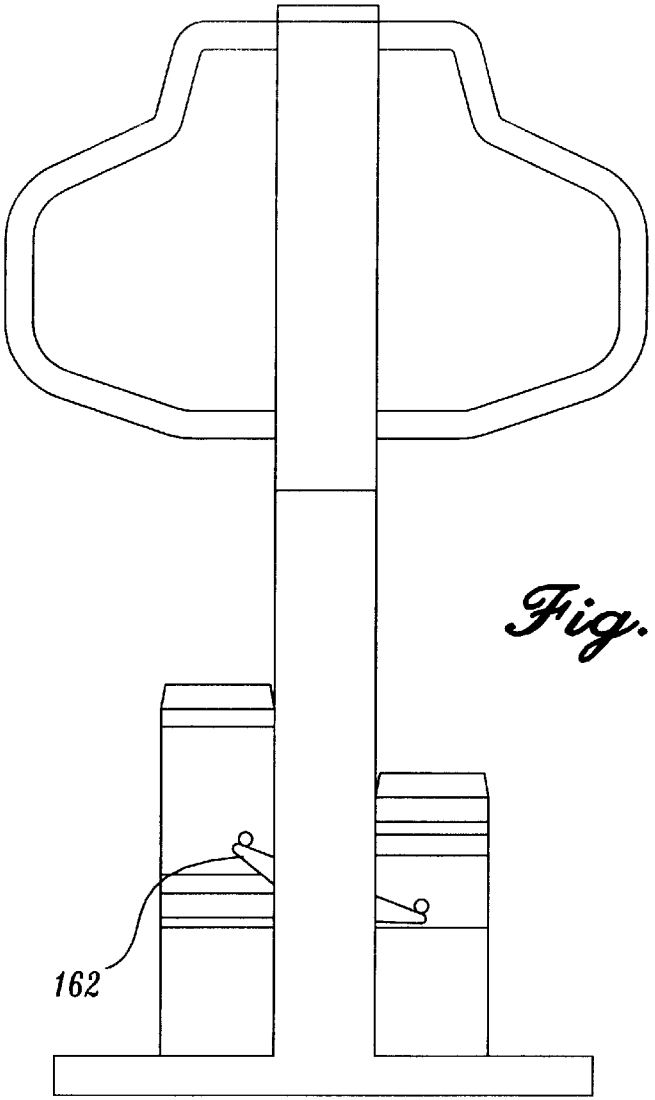
FIG. 6 illustrates a front view of the embodiment of the present invention shown in FIG. 4.
Figure 7:
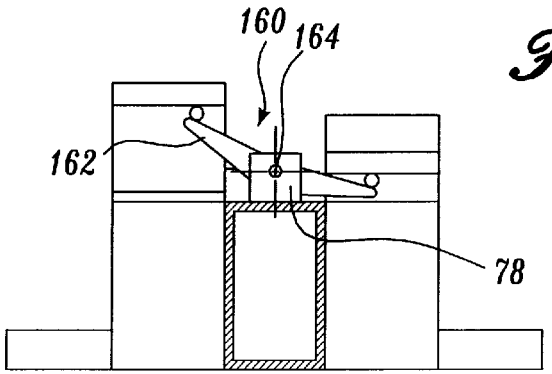
FIG. 7 illustrates a cross-sectional view of the embodiment of the present invention shown in FIG. 4.

FIGS. 1 and 2 illustrate a preferred embodiment of an independent elliptical motion exerciser 10 constructed in accordance with the present invention. The exerciser 10 includes a floor engaging frame 14 having a forward upright structure 18 that extends initially upwardly and then angles diagonally forward. Towards the rear region of the frame 14 are attached left and right axle mount supports 22 and 24 which house a transverse axle 26. The axle 26 is bifurcated allowing the two halves to rotate independently of one another and connecting with left and right drive wheels 30 and 32 respectively. Left and right foot link members 36 and 38 rollably engage the transverse axle 26 at the link member's rear end portions 48 and 50. The transverse axle 26 is connected to a flywheel 27 contained within a center housing 31. The forward end portions 42 and 44 of the foot link members rollably engage left and right inclinable guide ramps 60 and 62. The inclinable guide ramps 60 and 62 are biased rotationally upwardly, to resist downward forces, by biasing members such as left and right springs 74. Left and right foot support portions 54 and 56 containing toe straps or cups that are mounted on the foot link members 36 and 38 to aid in forward motion recovery. As the foot link members 36 and 38 reciprocate forwardly and rearwardly along the inclinable guide ramps 60 and 62, the interaction of the oscillating weight of a running or walking user on the foot support portions 54 and 56, with the independently upwardly biased inclinable guide ramps 60 and 62, causes the foot support portions 54 and 56 carried by the foot link members 36 and 38 to travel along various elliptical paths, as described more fully below.

As shown in FIGS. 1 and 2, one exemplary embodiment frame 14 includes a longitudinal central member 80 that terminates at front and rear, relatively shorter transverse members 82 and 84. Ideally, but not essentially, the frame 14 is composed of substantially rectangular tubular members, that are relatively light in weight but that provide substantial strength. Preferably, end caps 83 and 85 are securably connected to the opened ends of the shorter transverse members 82 and 84 to close off the ends of these members.

Connected to the exemplary floor engaging frame 14 is the forward upright structure 18. The upright structure contains a lower substantially vertical section 86 which transitions into an upper diagonal forward section 88. Ideally, but not essentially, the vertical section 86 and the diagonally forward section 88 of the forward upright structure 18 may also be composed of substantially rectangular tubular material, as described above. Preferably, an end cap 89 is also securably connected to the upper end of the diagonally forward section 88 to close off the opening therein.

A continuous, closed loop-type tubular handlebar 90 is mounted on the upward diagonal forward section 88 of the forward upright structure 18 for grasping by an individual while utilizing the present exerciser 10. Although any number of handlebar configurations could be utilized without departing from the scope of the present invention, the following is a description of one possible embodiment. The handlebar 90 includes an upper transverse section 92 that is securely attached to the upper region of the diagonally forward section 88 by way of a clamp or other structure. The handlebar 90 further includes side sections 96, each of which are composed of an upper diagonally disposed section that transitions into a lower section which flares downwardly and outwardly. The side sections 96 conclude by transitioning into a lower transverse section 98 that is attached at its center to the diagonally forward section 88 in the above-described manner. Although not shown, the handlebar 90 may be covered in whole or in part by a gripping material or surface, such as foam rubber.

Towards the rear of the frame 14 are located left and right axle mount supports 22 and 24. The axle supports are attached to the frame 14 and are configured to extend substantially upward. The upper surfaces of the axle mount supports 22 and 24 are shaped and sized to receive approximately the lower half of the drive wheels 30 and 32. Concave housings 102 and 104 on the upper surface of the axle supports 22 and 24 contain low friction engaging systems (not shown), such as bearing systems, to allow the drive wheels 30 and 32 to rotate within the concave housings 102 and 104 with little resistance.

In one exemplary embodiment, left pinch/idler roller 134A (not shown) and right pinch/idler roller 136A extend outwardly in opposite directions from the center housing 31 (which contains a flywheel 27) over the left and right drive wheels 30A and 32A (not shown), respectively, (which are correspondingly spool-shaped) to "capture" the foot link members 36 and 38 between the pinch/idler rollers 134A and 136A and the drive wheels 30A and 32A as shown in FIG. 2A. These pinch/idler rollers 134A and 136A and spool-shaped drive wheels 30A and 32A act to prevent lateral wobble of the foot link members 36 and 38.

Referring again to FIGS. 1 and 2, the transverse axle 26 is bifurcated, such that its left half and right half can rotate independently of one another. Each half of the transverse axle 26 connects to a flywheel 27 contained within the center housing 31. Such flywheels are standard articles of commerce. Left and right drive wheels 30 and 32 are located on top of the left and right axle mount supports 22 and 24, and are securably connected to their respective halves of the transverse axle 26. The drive wheels 30 and 32 are capstan-type drives and incorporate one-way clutch systems (not shown) such that greater force is required to rotate the drive wheels 30 and 32 towards the rear of the exerciser 10, than is required to rotate the drive wheels towards the front of the exerciser. Such clutch systems are standard articles of commerce.

The elliptical motion exerciser 10 further contains longitudinally disposed left and right foot link members 36 and 38. The foot link members are illustrated as in the shape of elongated beams and are relatively thin. The foot link members 36 and 38 are of a width substantial enough to accommodate the width of an individual user's foot. The foot link members 36 and 38 define lower surfaces 106 and 108, and upper surfaces 110 and 112, and are aligned in substantially parallel relationship with the longitudinal central member 80 of the frame 14.

The foot support portions 54 and 56 extend along the sides of and across the front ends of foot receiving and engagement pads 114 and 116, which provide stable foot placement locations for an individual user. The foot support portions 54 and 56 are configured to form toe straps or cups which aid in forward motion recovery at the end of the downward, rearward elliptical drive motion. The rear end portions 48 and 50 of the foot link member's lower surfaces 106 and 108 rollably engage the top of each half of the bifurcated transverse axle 26, which is exposed from the concave housings 102 and 104. In this manner, the left and right foot link members 36 and 38 engage the left and right drive wheels 30 and 32 as the foot link members reciprocate back and forth, such that the one-way clutch system (not shown) imports a greater resistance as the foot link members 36 and 38 are individually pushed backwards than when the foot link members are pushed forward. In one exemplary embodiment shown in FIG. 2A, the axle mount supports 22A and 24A are configured to incorporate springs 118A or other biasing mechanisms located under the drive wheels 30 and 32 to help smooth out the path traveled by the foot support portions 54 and 56, and dampen any undesirable jarring motion.

Referring again to FIGS. 1 and 2, left and right rollers 120 and 122 are coupled to the forward end portions 42 and 44 of the foot link members 36 and 38 to extend downwardly of the foot link lower surfaces 106 and 108. The rollers 120 and 122 rollably engage left and right inclinable guide ramps 60 and 62. The guide ramps 60 and 62 are illustrated as being of an elongated, generally rectangular shape and are relatively thin, somewhat similar to the configuration of the foot link members 36 and 38. The inclinable guide ramps 60 and 62 are of a width sufficient to support the rollers 120 and 122, and are of a length sufficient to substantially accommodate a full stride of an individual user whose feet are placed on the individual foot engagement pads 114 and 116 of the foot link members 36 and 38.

In an exemplary embodiment shown in FIG. 2A, the inclinable guide ramps 60A and 62A are formed with raised sidewalls 61A and 63A to laterally constrain the rollers 120A and 122A. Lateral movement of the foot link members 36 and 38 could also be constrained by utilizing spool-shaped rollers (not shown) having enlarged diameter rims at their ends to extend over the longitudinal edges of the inclinable guide ramps 60 and 62. In yet another exemplary embodiment, the foot link members 36 and 38 do not contain foot link rollers 120 and 122 but instead utilize sliders (not shown) or some other translational facilitating mechanism for interacting with the inclinable guide ramps 60 and 62.

As most clearly illustrated in FIG. 2, the inclinable guide ramps 60 and 62 pivot about axes 130 and 132 located near the rearward ends of the guide ramps. The inclinable guide ramps 60 and 62 are rotatably secured at their pivot axes 130 and 132 to left and right guide ramp mount supports 66 and 68 that extend upwardly from the frame 14. The inclinable guide ramps 60 and 62 are biased upwardly (in a counterclockwise direction when viewed from the left side of the exerciser 10 as shown in FIG. 2), by springs 74 or other biasing members to resist downward forces applied to the inclinable guide ramps 60 and 62. The lower ends of the springs 74 are secured to a biasing member mounting structure 78 that is in turn attached to the frame 14. Additionally, it is appreciated that any number of different biasing members could be used to provide resistance to the inclinable guide ramps such as air springs, isometric cones, pneumatic pressure systems, hydralic pressure systems, etc.

Referring again to FIG. 2A, the left and right biasing members 74 ideally employ adjustable resistance biasing mechanisms 144A for selecting a desirable level of resistance imposed by the biasing members 74 against the downward forces of the inclinable guide ramps 60A and 62A. Adjustable resistance biasing mechanisms 144A can be used to compensate for variations in the body weight of the user, as well as to alter the parameters of the elliptical path travelled by the user's feet.

The adjustable resistance biasing mechanisms, shown in FIG. 2A, utilize a variable resistance spring assembly 144A to allow the resistance level opposing the downward forces (imposed by the inclinable guide ramps 60A and 62A) to be adjusted. The resistance level produced by the spring is varied by preloading the spring 74 with a lead screw and motor against the opposing plunger within the spring cylinder. The opposing plunger is driven downwardly by the user's weight on the footlinks via the guide ramps (as shown in FIG. 2A). Numerous other types of adjustable resistance biasing members could also be utilized. These include adjustable resistance air springs which can be set at varying air pressures, and adjustable resistance fluid springs which can alter a value size through which the fluid in the spring must be forced. Further, biasing level adjustments could be achieved by adding or subtracting the number of springs or biasing members utilized.

To use the present invention, the user stands at the foot support portions 54 and 56. The user imparts a downward and rearward stepping action on one of the foot supports and a forward motion on the other foot support portion, thereby causing the drive wheels 30 and 32 to rotate (counterclockwise as viewed from FIG. 2) about the transverse axle 26. As a result, the rear end portions 48 and 50 of the foot link members 36 and 38 rollably engage the drive wheels 30 and 32 while the forward end portions 42 and 44 of the foot link members sequentially ride up and down the inclinable guide ramps 60 and 62. The forward end of each foot link member sequentially travels downwardly and rearwardly along its corresponding inclinable guide ramp as the rear end of that foot link member moves from the link's forwardmost location (the maximum extended position of the foot link) to the link's rearwardmost location (the maximum retracted position of the foot link). From this maximum retracted position of the foot link, the user then imparts a forward stepping motion on the foot support which rotates the corresponding drive wheel in the reverse direction (clockwise as viewed from FIG. 2) and causes the foot link member to travel back upwardly and forwardly along its corresponding inclinable guide ramp back to the maximum extended position of the foot link. As shown in FIG. 2, the path of travel drawn out by the foot supports is basically in the shape of a forwardly and upwardly tilted ellipse 140.

The interaction of the oscillating weight of a user produced by typical running or walking motion, with the upwardly biased resistance of the individual inclinable guide ramps 60 and 62, combine to produce a highly desirable bi-pedal independent elliptical motion. To further explain this effect, analysis of typical bi-pedal motion such as that produced by running, jogging, or walking is required. During the cycle created by a striding motion, maximum upward force is generated when an individual's foot is approximately at its furthest rearmost position. This upward force decreases as a striding individual's foot approaches the cycle's apex near the midpoint of the stride and then begins transitioning into downward force as the foot continues forward. Maximum downward force is produced when a striding individual's foot is approximately at its forward-most point in the cycle. This downward force in turn diminishes as the striding individual's foot approaches the midpoint of the cycle's lower path of travel. Completing the cycle, the upward force produced by the striding motion then increases until the force reaches its maximum at approximately the rearmost point of the cycle's path of travel.

Additionally, due to the rotational pivoting connection of the upwardly biased inclinable guide ramps 60 and 62, a torque lever arm is created. Thus, downward force applied to the inclinable guide ramps 60 and 62 imports a proportionally greater magnitude of rotational force onto the guide ramps, the further forward towards the non-pivoting end of the guide ramps, that the force is applied. The interaction of the force gradients produced during the cycle of a striding individual's path of travel, with the varying upwardly biased resistance produced by a individual user's path of travel along the length of the torque lever arm (guide ramp), results in a desirable independent elliptical motion, the exact parameters of which are determined by the forces input by an individual user.

FIGS. 4–7 illustrate another embodiment of an independent elliptical motion exerciser 150 constructed in accordance with the present invention. The exerciser 150 shown in FIGS. 4–7 is constructed similarly to the exerciser 10 shown in the prior figures. Accordingly, the exerciser 150 will be described only with respect to those components that differ from the components of the exerciser 10. The exerciser 150 does not contain left and right spring biasing members 74, but instead utilizes a transverse pivot arm ramp return assembly 160. The return assembly 160, includes a pivot arm 162 that engages the underside of each inclinable guide ramp 60 and 62, and is coupled to a mounting structure 78 at a central pivot axis 164, such that when one of the inclinable guide ramps pivots downwardly the return assembly 160 forces the other inclinable guide ramp to pivot upwardly. Thus, the return assembly 160 provides some degree of corresponding reciprocal motion between the inclinable guide ramps 60 and 62 in response to the alternating downward forces incurred from the striding motion of an individual user via the rollably connected foot link members 36 and 38.

Figure 8:
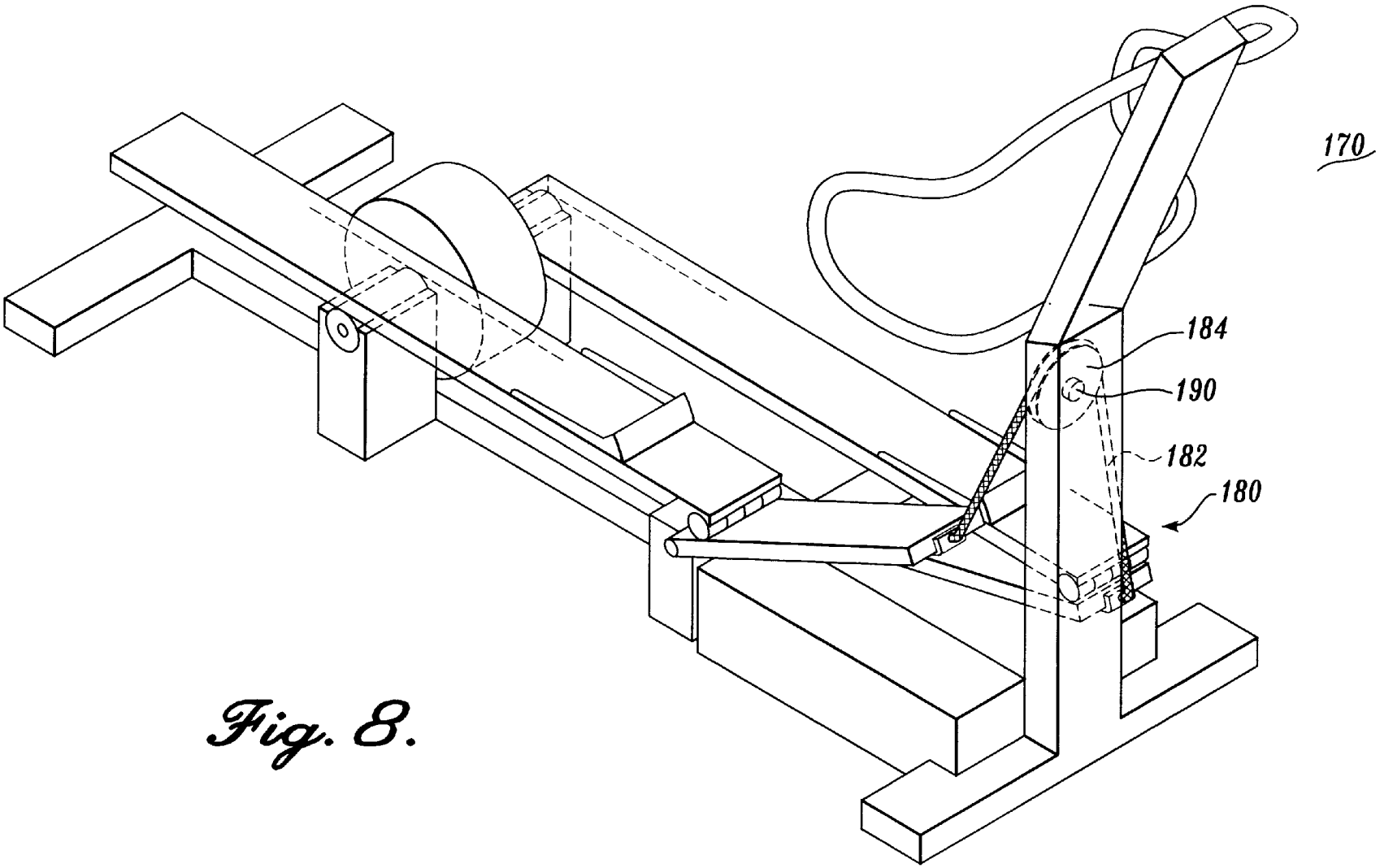
FIG. 8 illustrates an elevated perspective view of an independent elliptical motion exerciser of the present invention, utilizing a pulley and belt ramp return system.
Figure 9:
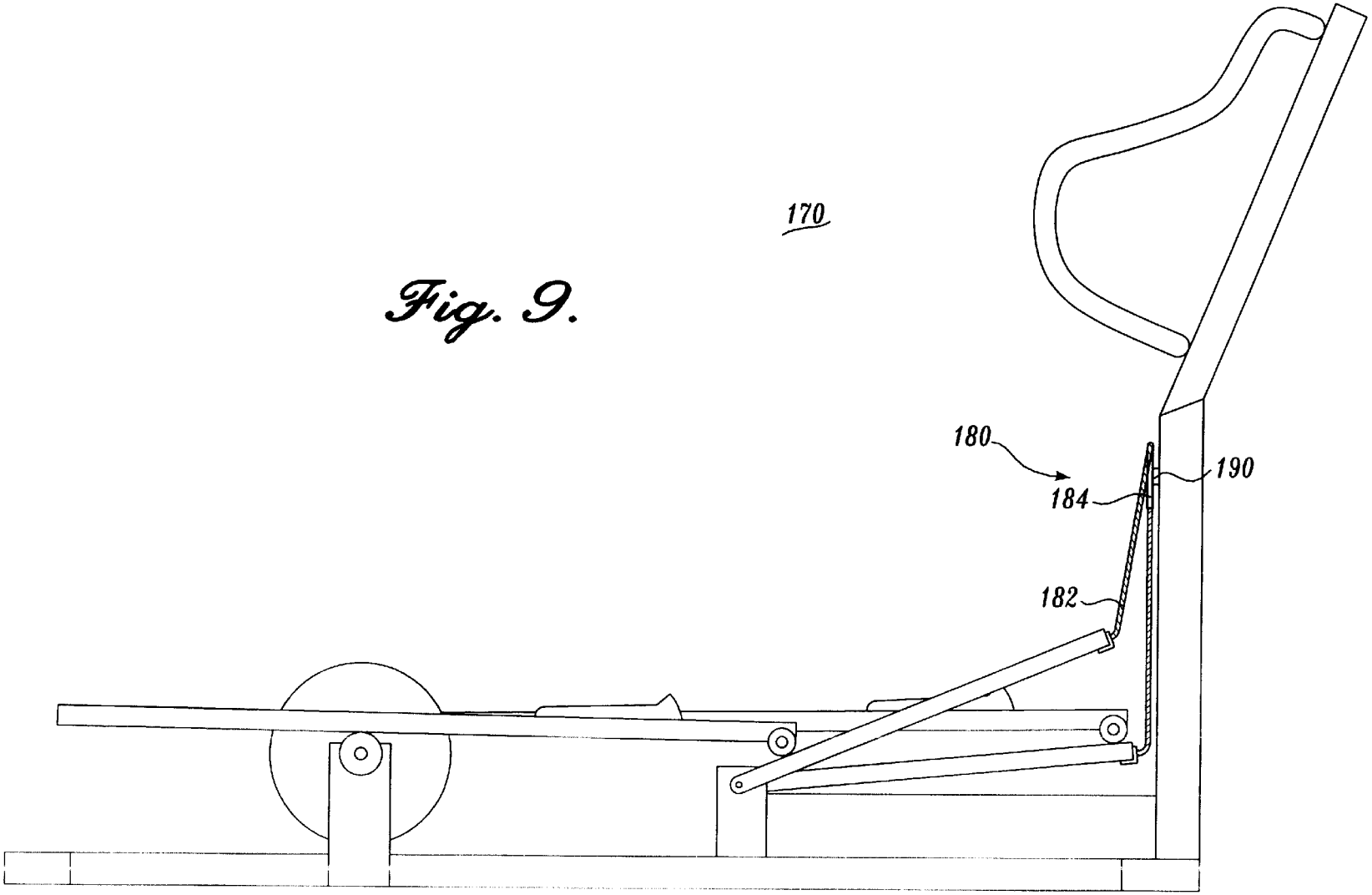
FIG. 9 illustrates a side view of the embodiment of the present invention shown in FIG. 8.
Figure 10:
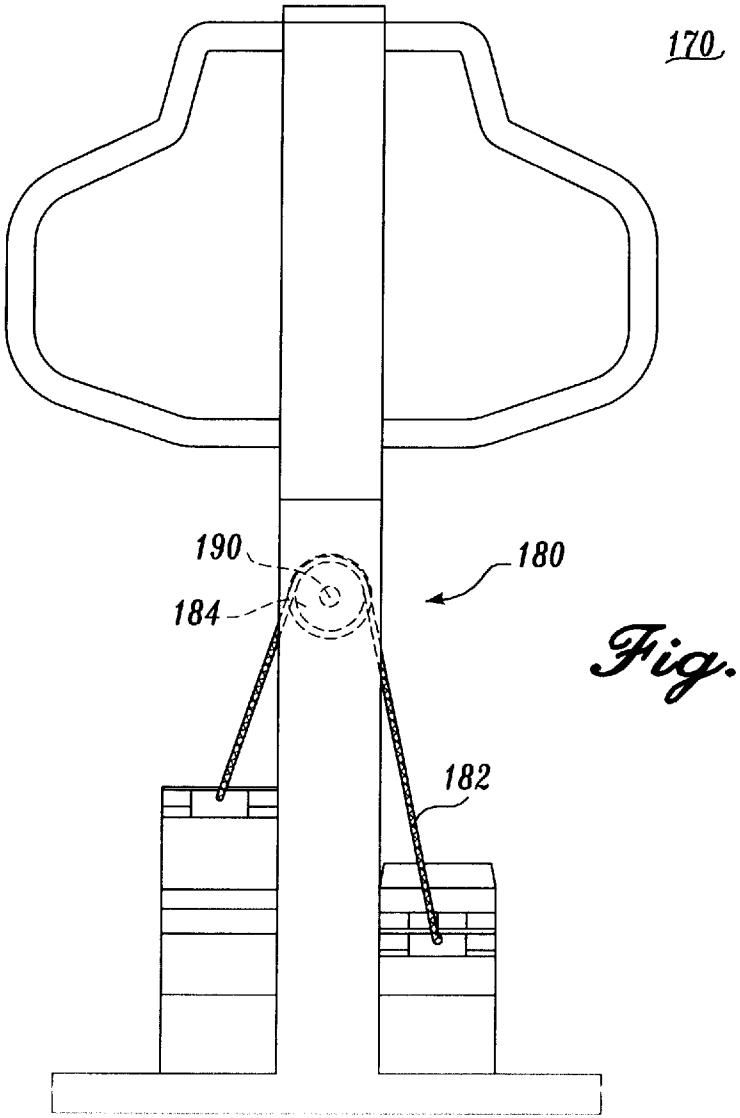
FIG. 10 illustrates a front view of the embodiment of the present invention shown in FIG. 8.

FIGS. 8–10 illustrates yet another embodiment of an independent elliptical motion exerciser 170 constructed in accordance with the present invention. The exerciser 170 shown in FIGS. 8–10 is constructed similarly to the exerciser 150 shown in FIGS. 4–7. Accordingly, the exerciser 170 will be described only with respect to those components that differ from the components of the exerciser 150. The exerciser 170 does not contain a transverse return assembly 160, but instead utilizes a pulley and belt system 180. In the pulley and belt system 180, a belt 182 is attached to the forward ends of the inclinable guide ramps 60 and 62, and loops over the top of a rotatable, elevated pulley wheel 184, such that when one of the inclinable guide ramps pivots downwardly the pulley and belt system 180 forces the other inclinable guide ramp to pivot upwardly.

The pulley wheel 184 is mounted on a pulley rotation hub 190 which is preferably secured to the upper region of the substantially vertical portion 86 of the forward upright structure 18. The connection of the pulley wheel 184 to the pulley rotation hub 190 preferably allows for not only planar rotation, but also for at least some degree of spherical rotation, such as that provided by a globoidal cam and oscillating follower type system, to aid in the self-alignment of the pulley wheel 184 in response to the multi-directional forces incurred from engagement of the belt 182. Preferably, the pulley wheel 184 also includes at least a partial housing cover, configured to help prevent the belt 182 from dislocating from the pulley wheel 184 during operation of the exerciser 170, as well as preventing a user's hands or feet from being pinched between the belt 182 and the pulley wheel 184. Like the transverse pivot ramp return 160, the pulley and belt system 180 provides some degree of corresponding reciprocal motion between the inclinable guide ramps 60 and 62 in response to the alternating downward forces incurred from the striding motion of an individual user via the rollably connected foot link members 36 and 38.

Preferred embodiments of the above-described variations of the present invention ideally, but not essentially, also include a lift mechanism 138A (as shown in FIG. 2A) for adjusting the angle of inclination of the ellipse traced out by the foot link members 36 and 38 within the exerciser 10A. The exemplary lift mechanism 138A rotates the biasing member mounting structure 78A (upon which the spring members 74 or other biasing members are mounted) about pivot mount 139A, thus raising or lowering the location on the mounting structure 78A at which the spring members 74 are secured. This allows the individual user of the exerciser 10A to customize the level of difficulty of the exercise and the muscle groups that are focused upon. Different lift mechanisms could also be used to accomplish this purpose that are known in the art. For example, another lift system could be employed that raised and lowered the forward end portion of the frame 14.

Another alternate embodiment of the present invention could utilize spring positioning adjustment tracks which would allow the location of the springs to be adjusted along the length of the inclinable guide ramps 60A and 62A and the mounting structure 78A, either closer or further away from their respective pivot axes 130 and 132. This would alter the resistance imported onto the inclinable guide ramps 60A and 62A by changing the position of the force distribution along the torque lever arm created by guide ramps 60A and 62A.

Additionally, preferred embodiments of all of the above-described variations of the present invention ideally, but not essentially further include a mechanism (not shown) for adjusting the resistance level produced by the one-way clutch of the drive wheel 30 and 32. Resistance adjustment devices are well known in the art and any of the variety of known methods may be utilized. The addition of a resistance adjustment device allows the individual user of the exerciser 10 to customize the level of difficulty of the exercise.

The present invention has been described in relation to a preferred embodiment and several alternate embodiments. One of ordinary skill after reading the foregoing specification, may be able to effect various other changes, alterations, and substitutions or equivalents without departing from the concepts disclosed. It is therefore intended that the scope of the letters patent granted hereon be limited only by the definitions contained in the appended claims and equivalents thereof The embodiments of the invention in which an exclusive property or privilege is claimed are defined as follows:

1. An exercise device, comprising:

a frame having a transverse, staionary, rotatable axle defined thereon, the frame configured to be supported on a floor;

a first and second foot link, each foot link including a first end portion, a second end portion and a foot support portion therebetween, each said foot link being rollably associated with the transverse axle such that the foot support portion of each foot link travels in a reciprocal path, a first inclinable guide ramp pivotally connected to the frame for directing the first end portion of the first foot link for reciprocal travel along the length of the ramp independent from said second foot link, the first guide ramp being operatively associated with the first end of the first foot link such that the ramp's incline is related to the position of the first end portion of the first foot link along the first ramp; and a second inclinable guide ramp pivotally connected to the frame for directing the first end portion of the second foot link for reciprocal travel along the length of the ramp independent from said first foot link, the second guide ramp being operatively associated with the first end of the second foot link such that the ramp's incline is related to the position of the first end portion of the second foot link along the second ramp.

2. The exercise device of claim 1, wherein the guide ramps associate with the respective foot links such that the foot support portions of the first and second foot links travel along independent generally elliptical paths.

3. The exercise device of claim 1, further comprising resilient members that bias the guide ramps upwardly against downward forces incurred from the operatively associated foot links.

4. The exercise device of claim 3, further comprising adjustable resistance biasing members that are operatively associated with the resilient members, whereby the degree to which the adjustable resistance biasing members bias the guide ramps upwardly can be altered.

5. The exercise device of claim 3, further comprising a resilient member lift mechanism for adjusting the elevation of the resilient members, and thereby adjusting the angular inclination of the reciprocal path traveled by the foot support portions.

6. The exercise device of claim 3, wherein the resilient members comprise springs that bias the guide ramps upwardly against downward forces incurred from the operatively associated foot links.

7. The exercise device of claim 1, wherein the guide ramps are linked together by a pivoting assembly that causes one ramp to pivot downwardly as the other ramp pivots upwardly in response to downward forces incurred from the operatively associated foot links.

8. The exercise device of claim 7, wherein the guide ramps are linked together by a transverse pivot-arm ramp return having a central pivot axis that causes one ramp to pivot downwardly as the other ramp pivots upwardly in response to downward forces incurred from the operatively associated foot links.

9. The exercise device of claim 7, wherein the guide ramps are linked together by a pulley and belt system that causes one ramp to pivot downwardly as the other ramp pivots upwardly in response to downward forces incurred from the operatively associated foot links.

10. The exercise device of claim 1, wherein the operative association of the foot links with the guide ramps acts to vary the angular orientation of the foot links relative to the frame.

11. The exercise device of claim 1, wherein the foot links rollably engage the guide ramps.

12. The exercise device of claim 11, wherein the guide ramps and corresponding rollably engageable foot links are shaped and sized in a configuration that facilitates the lateral containment of the rollably engageable foot links by the guide ramps.

13. The exercise device of claim 1, further comprising a flywheel operatively connected to the transverse axle, said flywheel located at approximately the midpoint of the transverse axle.

14. The exercise device of claim 1, wherein the second end portions of the foot links are operatively connected to a capstan type drive located at the transverse axle.

15. The exercise device of claim 14, wherein resilient members operatively connect the capstan type drive to the frame, thereby dampening the motion of the rollably associated foot links on the transverse axle as the foot support portion of each foot link travels in a reciprocal path.

16. The exercise device of claim 14, wherein the device further comprises:

(a) a center housing located at approximately the midpoint of the transverse axle, whereby the center housing is capable of enclosing a flywheel; and (b) pinch/idler rollers extending outwardly from the center housing above the transverse axle to rollably engage the foot links.

17. The exercise device of claim 16, wherein the capstan type drive is configured to form spool-shaped drive wheels, and the pinch/idler rollers and the spool-shaped drive wheels are positioned to act in conjunction with each other to capture a corresponding foot link therebetween and thus, provide lateral retention of the foot links.

18. The exercise device of claim 1, wherein the second end portions of the foot links are operatively associated with a one-way clutch by way of the transverse axle.

19. The exercise device of claim 18, wherein the one-way clutch imports a greater resistance when the foot support portions of the foot links move from a forward to the rearward position than in moving from a rearward to a forward position.

20. The exercise device of claim 18, wherein the level of resistance imported by the one-way clutch is adjustable.

21. An exercise device, comprising:

a frame having a transverse, staionary, rotatable axle defined thereon, the frame configured to be supported on a floor;

a first and second foot link, each foot link including a first end portion, a second end portion and a foot support portion therebetween;

a drive system operatively associated with each foot link by way of the transverse axle which rollably contacts each foot link such that the foot support portion of each foot link travels in a reciprocal path; and first and second inclinable guide ramps pivotal relative to the frame for directing the first end portions of the foot links in mutually independent reciprocal travel along the length of their respective guide ramps, the first and second guide ramps being operatively associated with the first end portions of said first and second foot links, respectively, such that the inclines of the ramps are related to the positions of the first end portions of the foot links along the respective ramps.

22. The exercise device of claim 21, wherein the guide ramps associate with the respective foot links causing the foot support portions of the first and second foot links travel along independent elliptical paths.

23. The exercise device of claim 21, wherein the guide ramps are biased upwardly by resilient members against downward forces incurred from the operatively associated foot links.

24. The exercise device of claim 23, wherein the resilient members comprise springs that bias the guide ramps upwardly against downward forces incurred from the operatively associated foot links.

25. The exercise device of claim 21, wherein the guide ramps are linked together so as to cause one ramp to pivot downwardly as the other ramp pivots upwardly in response to downward forces incurred from the operatively associated foot links.

26. The exercise device of claim 25, wherein the guide ramps are linked together by a transverse pivot-arm ramp return having a central pivot axis that causes one link to pivot downwardly as the other link pivots upwardly in response to downward forces incurred from the operatively associated foot links.

27. The exercise device of claim 21, wherein the guide ramps are linked together by a pulley system that causes one link to pivot downwardly as the other link pivots upwardly in response to downward forces incurred from the operatively associated foot links.

28. The exercise device of claim 21, wherein the operative association of the foot links with the guide ramps acts to vary the angular orientation of the foot links relative to the frame.

29. The exercise device of claim 21, wherein the foot links rollably engage the guide ramps.

30. The exercise device of claim 21, wherein the foot links are operatively connected to a capstan type drive by way of the transverse axle.

31. The exercise device of claim 21, wherein the foot links are operatively associated with a one-way clutch by way of the transverse axle.

32. The exercise device of claim 31, wherein the one-way clutch imports a greater resistance when the foot support portions of the foot links move from a forward to the rearward position than in moving from a rearward to a forward position.

33. The exercise device of claim 31, wherein the level of resistance imported by the one-way clutch is adjustable.

34. An exercise device, comprising:

a frame having a bifurcated transverse, staionary, rotatable axle defined thereon, the frame configured to be supported on a floor;

a first and second foot link, each foot link including a first end portion a second end portion and a foot support portion;

a bifurcated drive system, each half of which is independently operatively associated with a respective foot link by rollably engaging the second end portion of each foot link;

first and second tiltable guide ramps pivotally supported by the frame for directing the first end portions of the foot links mutually independently along the length of the respective ramps, the first and second guide ramps cooperatively associated with the first end portions of said first and second foot links respectively, such that the inclination of the ramps are related to the positions of the first end portions of the foot links along the respective ramps; and whereby as the first and second foot links travel forward and aft, the foot support portions of the foot links travel along elliptical paths.

* * * * *

UNITED STATES PATENT AND TRADEMARK OFFICE

CERTIFICATE OF CORRECTION

PATENT NO. : 6,123,650
DATED : September 26, 2000
INVENTOR(S) : J.S. Birrell

It is certified that error appears in the above-identified patent and that said Letters Patent is hereby corrected as shown below:

Title page,
Item [57], ABSTRACT,
Line 5, “bifurcated allowing” should read -- bifurcated, allowing --
Line 20, “causes” should read -- cause --

Column 1,
Line 16, “have” should read -- has --
Line 22, “equipment, is” should read -- equipment is --
Line 29, “art, however” should read -- art; however, --
Line 36, “thereby, limits” should read -- thereby limits --
Line 39, “bicycles, however,” should read -- bicycles; however, --
Line 49, “art, is” should read -- art is --

Column 2,
Line 32, “links relative” should read -- links, relative --
Line 61, “adjustably” should read -- adjustable --
Line 65, “members.” should read -- members; --

Column 3,
Lines 29-30, “bifurcated allowing” should read -- bifurcated, allowing --
Line 41, “containing” should read -- contain --
Line 52, “2, one exemplary” should read -- 2, in one exemplary --
Line 54, “relatively shorter transverse” should read -- relatively shorter, transverse --

Column 6,
Line 2, “ramp such as” should read -- ramps, such as --

Column 7,
Line 33, “160,” should read -- 160 --
Line 45, “illustrates” should read -- illustrate --

Column 8,
Line 59, “thereof” should read -- thereof. --
Line 63, “staionary,” should read -- stationary, --

Column 9,
Line 4, “path,” should read -- path; --

UNITED STATES PATENT AND TRADEMARK OFFICE

CERTIFICATE OF CORRECTION

PATENT NO. : 6,123,650
DATED : September 26, 2000
INVENTOR(S) : J.S. Birrell

It is certified that error appears in the above-identified patent and that said Letters Patent is hereby corrected as shown below:

Column 10,
Line 26, “thus,” should read -- thus --
Line 39, “staionary,” should read -- stationary --
Line 60, “links travel” should read -- links to travel --

Column 12,
Line 7, “staionary,” should read -- stationary --
Line 12, “portion” should read -- portion, --
Line 24, “are” should read -- is --

Signed and Sealed this

Twenty-ninth Day of October, 2002

*Attest:*

*Attesting Officer*

JAMES E. ROGAN
*Director of the United States Patent and Trademark Office*